United States Patent [19]

Bomba

[11] Patent Number: 5,055,111

[45] Date of Patent: Oct. 8, 1991

[54] OXIDIZED POLYGALACTOMANNAN FOR IMPROVED TEXTILE WASHING OF PAD-DYED CARPET

[75] Inventor: Bruce W. Bomba, Karnes City, Tex.

[73] Assignee: Aqualon Company, Wilmington, Del.

[21] Appl. No.: 497,521

[22] Filed: Mar. 19, 1990

[51] Int. Cl.[5] ..... C09B 67/00

[52] U.S. Cl. ..... 8/561; 8/110; 8/111; 8/115.69; 8/636; 8/929

[58] Field of Search ..... 8/561

[56] References Cited

U.S. PATENT DOCUMENTS

| | | | |
|---|---|---|---|
| 4,502,867 | 3/1985 | Reinhardt | 8/557 |
| 4,802,558 | 1/1990 | Blyth et al. | 8/560 |
| 4,826,504 | 5/1989 | Clare et al. | 8/561 |
| 4,859,208 | 8/1989 | Clare et al. | 8/557 |

OTHER PUBLICATIONS

E. R. Trotman, "Dyeing and Chemical Technology of Textile Fibres"; Sixth Ed. (Wiley), 1984, pp. 313, 490–491 and 508–509.

R. W. Moncrieff, "Man-Made Fibres"; (Wiley), Sixth Ed., 1975; pp. 455–456.

*Primary Examiner*—A. Lionel Clingman

*Attorney, Agent, or Firm*—James K. Luchs

[57] ABSTRACT

Raw material costs are lowered and effluent BOD is improved when high molecular weight guar combined with 0.1 to 1.0% sodium persulfate are added prior to heat treatment during textile fiber processing. Productivity is improved for stain-resistant treatment of carpet.

13 Claims, No Drawings

OXIDIZED POLYGALACTOMANNAN FOR IMPROVED TEXTILE WASHING OF PAD-DYED CARPET

FIELD OF THE INVENTION

This invention relates to the treatment of textiles by liquid application and washing. In particular this invention relates to an oxidized polygalactomannan textile fiber treatment.

BACKGROUND OF THE INVENTION

It is known in the art to dye, treat and wash textiles with a variety of materials and agents. It is common practice to apply chemical compositions which alter the surface properties of textile fibers and afterwards remove excess material in a washing step. Waterproofing and stain-resist chemicals are currently being applied to upholstery and carpets in such a manner. DuPont and Monsanto market stain-resist chemicals respectively. These are described in trade literature and patents such as U.S. Pat. No. 4,892,558.

In spite of the benefit which these and other textile treatment agents provide for the consumer, there are still needs which exist for the textile manufacture which have remained unresolved. Often large quantities of expensive chemicals are required along with large quantities of water in order to produce satisfactory textile materials in textile mills. Thus, it would be a new and useful result to provide a means to make chemical application and washing more productive.

SUMMARY OF THE INVENTION

A composition for treating textile fibers comprises polygalactomannan with a molecular weight above 500,000 in combination with from 0.1 to 1.0 percent by weight of an oxidizing agent capable of depolymerizing polygalactomannan in an aqueous media of a temperature above 95° C. Preferably the poly galactomannan is guar gum with a molecular weight above 1,000,000 and the oxidizing agent is sodium persulfate in an amount of 0.3 to 0.8 percent by weight.

A process for treating textile fibers with a chemical composition and subsequent washing comprises the steps:

(1) adding polygalactomannan with a molecular weight above 500,000 in combination with from 0.1 to 1.0 percent by weight of an oxidizing agent to a textile fiber material;

(2) heating the textile fiber material in the presence of water, polygalactomannan and oxidizing agent at a temperature of at least 95° C.;

(3) washing to remove polygalactomannan and oxidation by-product;

(4) applying a fiber treatment agent to the textile fiber material, and (5) washing the textile fiber material with water.

It is preferred that in step (1) guar gum having a molecular weight above 1,000,000 is used in combination with sodium persulfate as an oxidizing agent; in step (2) steam is the heating means; in step (3) the fiber treatment agent is a stain-resist chemical; and overall the Biological Oxygen Demand (BOD) of the water is lowered.

DETAILED DESCRIPTION OF THE INVENTION

The following flow charts illustrate first a generalized textile treatment operation and second a specific textile mill operation for carpet manufacture.

| | |
|---|---|
| | General Textile Treatment |
| Textile Fiber | (Cotton, synthetic, wool, etc.) |
| Dyeing | (Polygalactomannan thickener such as guar gum used during dye application) |
| Heat Setting | (Heat is used to set the dye into the fiber) |
| Washing | (Removal of guar and dye) |
| Fiber Treatment | (A variety of chemicals may be applied for waterproofing or stain production) |
| Washing | (Excess chemicals are removed) |
| Product Manufacture | (Treated fibers may receive other treatments or go through additional manufacturing steps to provide a consumer product) |
| | Carpet Manufacturing |
| Yarn | (Synthetic or wool) |
| Tufting | Yarn knitted into primary polypropylene backing |
| Dyeing | Guar gum applied by itself or as a dye/guar mixture. |
| Steaming | (Steaming process sets the dye into the carpet fiber) |
| Washing | (Residual guar and dye are removed |
| Water Removal | (Wet carpet passes over suction that pulls out most of the moisture) |
| Chemical Treatment | (Stain resistant chemicals are applied) |
| Steaming | (Set chemicals into fibers) |
| Washing | (Residual chemicals are removed |
| Water Removal | (Wet carpet passes over suction that pulls out most of the moisture) |
| Drying | (Wet carpet passes through hot air dryer) |
| Finished Carpet | (Final backing can be applied at this point) |

The present invention takes advantage of existing steps in the textile manufacturing process to provide increased productivity for the textile manufacturer. As shown in the flow charts, dyeing and treatment steps are followed by heat treatment/steaming and water removal/washing steps. Yet even with a complete knowledge of the existence of these steps, the full benefits were only discovered by actual test of the novel process.

In detail the process of the invention involves using the heat ordinarily employed in the textile manufacturing process to effect the depolymerization of polygalactomannan (guar) in the presence of an oxidizing agent such as sodium persulfate. The benefits provided are:

(1) prior to the heating step (i.e., before depolymerization), the high molecular weight guar gum provides high viscosity and provides maximum assistance for modification of the fibers;

(2) while a dye or other treatment agent is being set into the fiber, the guar undergoes depolymerization at the exact time that high molecular weight and high viscosity are no longer required;

(3) washing occurs after the heat treatment has converted an oxidizing agent such as sodium persulfate into inactive by-products along with converting the guar to an easily removed lower molecular weight form such that the wash water contains guar and no objectionable chemicals;

(4) guar which would tend to remain attached to the textile fibers as a layer is readily removed when the guar is oxidized during heat treatment followed by washing with water;

(5) effective removal of guar from the textile fibers allows greater efficiency in chemical treatment of the fibers such as with stain-resistant chemicals allowing lower amounts to be used;
(6) the use of lower amounts of treatment chemicals results in lower BOD levels in plant effluent after washing; and
(7) effective removal of a layer of guar from the fibers is believed to add to the permanency of a stain-resistant treatment in the event that cracking and flaking off of guar can cause stain-resistant chemicals to be lost from the fiber surface.

Actual benefits which can be observed and measured by textile mill manufacturers included the following where materials prepared according to the present invention were compared with materials prepared by the existing state of the art:

(1) the "hand feel" of the fibers was improved in the absence of residual guar thereby giving an artisan reason to believe that a superior product would be produced after subsequent processing steps and finishing;
(2) dyed fibers had good color and pattern definition;
(3) wash water effluent free of persulfate;
(4) fibers were produced which contained no residual guar;
(5) lower amounts of stain-resist chemical treatment are required;
(6) overall waste water BOD levels were significantly reduced.

A polygalactomannan suitable for the practice of the invention is Galaxy ®1084, available from the Aqualon Company. Other polygalactomannan products can be employed provided they have a molecular weight above about 500,000 sufficient to provide a Brookfield viscosity at 25° C. of at least 4300 cps for a 1% aqueous solution. It is preferred that the guar have a molecular weight above 1,000,000.

Sodium persulfate is the preferred oxidizing agent but other oxidizing agents such as potassium persulfate or hydrogen peroxide could also be employed which react to produce nonobjectionable by-products. For example, potassium permanganate could be employed where it would be desirable to be able to observe the disappearance of purple color as a measure of reaction completion and a magnesium by-product was not objectionable. The choice of an oxidizing agent often depends on its compatibility with the dye system used for dying the textile fibers.

A preferred chemical treatment following the oxidative depolymerization of the present invention is the application of DuPont StainMaster® stain-resistant chemicals. This is not to say that the improvements of the invention are in any way limited to stain-resistant chemicals. It is simply that this has been involved in the best documented reduction to practice which is illustrated in the following examples.

The following examples illustrate the industrial applicability of the invention to textile manufacture and processing. Parts or percentages are by weight unless otherwise specified. Example 1 represents the best mode.

EXAMPLE 1

An aqueous solution was prepared by adding 100 pounds of Galaxy® 1084 guar gum (Aqualon Company) blended with 0.5% by weight sodium persulfate to 1000 gallons of water and mixing.

A comparison solution was prepared of only guar gum and water.

The guar and sodium persulfate solution was substituted for the standard comparison solution in a carpet manufacturing process as shown in the flow chart during the dyeing step.

Following the steaming, washing and water removal steps, plant operators felt carpet samples made with the comparison solution and the guar and sodium persulfate solution. It was reported that the control material felt harder and stiffer, whereas carpet fibers which had received the oxidative treatment were softer and more flexible. Water analysis can confirm what no persulfate ions remain in the wash water effluent.

Both a control carpet and a guar/persulfate treated carpet then were treated with DuPont StainMaster® soil-resistant chemical followed by steaming, washing, water removal and drying. While both samples gave equivalent stain protection in laboratory testing, the wash water effluent of the experiment had a significantly lower BOD value. This suggests that lower amounts of soil-resistant chemicals could be employed in the process. All other properties of the control and experimental carpet samples were equivalent.

EXAMPLE 2

The process of Example 1 was repeated except that 0.3 and 0.8% sodium persulfate were used with the guar gum. Completely satisfactory results were obtained in comparison with a control using only guar. However, washability and BOD reduction were not considered to be as good as in Example 1.

EXAMPLE 3

A guar depolymerization can be performed as in Example 1 except that potassium persulfate can be substituted for sodium persulfate. Equivalent depolymerization would be obtained.

This illustrates that other alkali metal persulfates would be expected to be suitable for the practice of the present invention as well as other similar oxidizing agents such as hydrogen peroxide, provided only that these oxidizing agents do not interfere with one of the textile processing steps.

EXAMPLE 4

Examples 1 and 2 can be repeated except that different fibers, dyes and chemical treatment chemicals can be used while a guar to oxidizing agent ratio is maintained between 0.1 to 1.0% by weight based on the weight of guar. Advantages in BOD effluent can be observed without sacrifice of textile quality or appearance.

What is claimed is:

1. A process for dyeing carpet textile fibers and subsequently treating the textile fibers with a stain-resistant chemical and washing comprises the steps:

(1) adding dye and a polygalactomannan with a molecular weight above 500,000 in combination with from 0.1 to 1.0 percent by weight based on the weight of the polygalactomannan of an oxidizing agent to a textile fiber material in the presence of water wherein the polygalactomannan provides high viscosity for the dyeing of the textile fiber;
(2) heating the dyed textile fiber material in the presence of water, polygalactomannan and oxidizing agent at a temperature of at least 95° C. wherein the dye is set in the textile fiber material and the polygalactomannan is depolymerized;

(3) washing to remove depolymerized polygalactomannan and oxidation by-product;

(4) applying a stain-resist chemical to the textile fiber material; and (5) washing the textile fiber material with water.

2. The process of claim 1 where the polygalactomannan has a molecular weight above 1,000,000.

3. The process of claim 2 where the oxidizing agent is an alkali metal persulfate.

4. The process of claim 3 where the oxidizing agent is sodium persulfate.

5. The process of claim 4 where the sodium persulfate is used in an amount of from 0.3 to 0.8 percent by weight.

6. The process of claim 3 where the polygalactomannan is guar.

7. The process of claim 6 where step (2) is performed using steam.

8. The process of claim 7 where a steam treatment is used between steps (4) and (5).

9. A process for carpet dyeing and stain treatment using guar in a dye solution, characterized in that the process involves the steps:

(1) applying a solution of dye, guar and sodium persulfate to carpet fibers;

(2) heating to depolymerize the guar and set the dye;

(3) washing to remove depolymerized guar;

(4) treating the carpet fibers with stain-resistant chemicals;

(5) treating the fibers with steam; and (6) washing the fibers with water wherein the Biological Oxygen Demand (BOD) of the resulting wash water is lowered.

10. The process of claim 9 where the sodium persulfate is used in an amount of 0.3 to 0.8 percent by weight based on the weight of the guar.

11. The process of claim 10 where the guar has a molecular weight above 1,000,000.

12. A thickening composition for addition to a dye solution for textile fibers comprises guar with a molecular weight above 1,000,000 in combination with from 0.1 to 1.0 percent by weight of an oxidizing agent based on the weight of guar wherein the guar depolymerizes upon being heated above 95° C.

13. The thickening composition of claim 12 where the oxidizing agent is sodium persulfate in an amount of 0.3 to 0.8 percent by weight.

* * * * *